United States Patent [19]

Regan

[11] 4,127,991

[45] Dec. 5, 1978

[54] APPARATUS FOR LEVELING AND SUPPORTING A SUB-SEA DRILLING TEMPLATE

[75] Inventor: A. Michael Regan, Huntington Beach, Calif.

[73] Assignee: Regan Offshore International, Inc., Torrance, Calif.

[21] Appl. No.: 822,697

[22] Filed: Aug. 8, 1977

[51] Int. Cl.[2] ..... E02D 21/00

[52] U.S. Cl. ..... 405/202; 405/196; 175/7; 248/23

[58] Field of Search ..... 61/86, 87, 88, 89, 92, 61/95; 175/7; 248/23; 403/379, 283

[56] References Cited

U.S. PATENT DOCUMENTS

| | | | |
|---|---|---|---|
| 720,998 | 2/1903 | Becker | 61/95 |
| 3,206,151 | 9/1965 | Lillestrand | 248/23 X |
| 3,310,108 | 3/1967 | Yancey | 175/7 X |
| 3,344,370 | 9/1967 | Sewell | 403/283 X |
| 3,390,654 | 7/1968 | Bromell et al. | 175/5 X |
| 3,735,597 | 5/1973 | Guy | 61/95 |
| 3,754,403 | 8/1973 | Mott et al. | 61/53.5 |
| 3,777,688 | 12/1973 | Melhose | 175/7 X |
| 3,991,581 | 11/1976 | Kolb | 61/53.5 |
| 4,045,967 | 9/1977 | Schirtzinger | 61/86 |

*Primary Examiner*—Dennis L. Taylor
*Attorney, Agent, or Firm*—Poms, Smith, Lande & Glenny

[57] ABSTRACT

An apparatus and method for leveling and supporting a sub-sea drilling template for sub-sea well drilling operations have support frame means for providing a stable reference surface for the sub-sea drilling template relative to an underlying sea bottom surface, universal pivot means operationally interconnecting the support frame means and the template for pivotally supporting the template with respect to the sea bottom surface and leveling means operationally interconnecting the support frame means and the template for varying the angular orientation of the template about the pivot means relative to the support frame means. Additionally, retaining means are provided for fixedly securing the template with respect to the support frame means once a desired angular orientation therebetween has been achieved.

11 Claims, 11 Drawing Figures

1
1a
2
3
5
5a
10
15a
20
30
31
34
35
55
II
III
IV

X
X
1
3
62
63
61
64
62
1
7
6
273
272
264
263
62
1
278
270
271
61
61a
7
71
78
70
63
64
77b
76b
74a
75
74
77a
72
76a
73
62
61a
7
61
71
64
70
76b
77b
72
74
74a
75
77a
76a

APPARATUS FOR LEVELING AND SUPPORTING A SUB-SEA DRILLING TEMPLATE

BACKGROUND OF THE INVENTION

The present invention relates in general to apparatus and a method for well drilling wherein a drilling template is first oriented relative to an underlying surface and then serves as a support structure for a subsequently installed well head christmas tree assembly. More specifically, the present invention relates to an apparatus and method for leveling and supporting a sub-sea drilling template for sub-sea well drilling operations which is lowered to the sea bottom and is then leveled and secured relative to the sea bottom surface from a remote location such as a drilling vessel or drilling platform on the surface of the sea.

Heretofore, it has been common when drilling sub-sea wells to either assemble and level the sub-sea drilling template in situ on the sea bottom by the use of human divers or, in the alternative, to assemble the sub-sea drilling template at the surface installation and then lower the assembled drilling template to the sea bottom where it was once again leveled by various processes which included the use of human divers either as observers or to actually accomplish the leveling itself.

Dur to the mass of a sub-sea drilling template, the power requirements for raising and lowering the template in its entirety are prohibitive. Additionally, as sub-sea drilling exploration expands into those areas of the continental shelf and beyond wherein the sea depth in extreme, the use of human divers to adjust and level the drilling template is not possible.

SUMMARY OF THE INVENTION

It is therefore a primary object of the present invention to disclose and provide an improved apparatus and method for leveling and supporting a sub-sea drilling template for sub-sea well drilling operations which will allow the template to be leveled from a remote location such as a drilling platform or drilling vessel on the surface of the sea.

It is a further object of the present invention to disclose and provide an improved apparatus and method which decreases system cost by eliminating the need for human divers during installation and operation.

It is a further object of the present invention to disclose and provide an apparatus and method for leveling and supporting a sub-sea drilling template which is operable under those conditions where the sea depths are too great or the diving conditions are too dangerous for human divers.

It is a further object of the present invention to disclose and provide an improved apparatus and method for leveling and supporting a sub-sea drilling template which eliminates the problems inherent with actually lifting the entire mass of the sub-sea drilling template in order to level and support the template.

It is a further object of the present invention to disclose and provide an apparatus and method for securing the sub-sea drilling template with respect to an underlying sea bottom surface once a desired angular orientation therebetween has been achieved.

Generally stated, the present invention in an improved apparatus for leveling and supporting a sub-sea drilling template includes the provision of support frame means for providing a stable reference surface for the template relative to an underlying sea bottom surface, universal pivot means operationally interconnecting the support frame means and the template for pivotally supporting the template with respect to the sea bottom surface and leveling means operationally interconnecting the support frame means and the template for varying the angular orientation of the template about the pivot means relative to the support frame means. Additionally, retaining means are provided for fixedly securing the template with respect to the support frame means once a desired angular orientation therebetween has been achieved.

Additionally, a method for leveling and supporting a sub-sea drilling template is disclosed which has the steps of providing a stable reference surface for the template relative to an underlying sea bottom surface, operationally interconnecting the reference surface and the template, pivotally supporting the template with respect to the reference surface and pivotally varying the angular orientation of the template relative to the reference surface.

Additionally, an improved apparatus and method for leveling and supporting a sub-sea drilling template is provided which may be operated to pivotally vary the angular orientation of the template relative to a reference surface from a remote location such as a drilling platform or drilling vessel on the surface of the sea.

A more complete understanding of the improvements in a sub-sea leveling and support apparatus and method for leveling and supporting a sub-sea drilling template for sub-sea well drilling operations in accordance with the present invention, will be afforded to those skilled in the art from a consideration of the following detailed description of an exemplary embodiment thereof. Reference will be made to the appended sheets of drawings which will first be discussed briefly.

Figure 1:
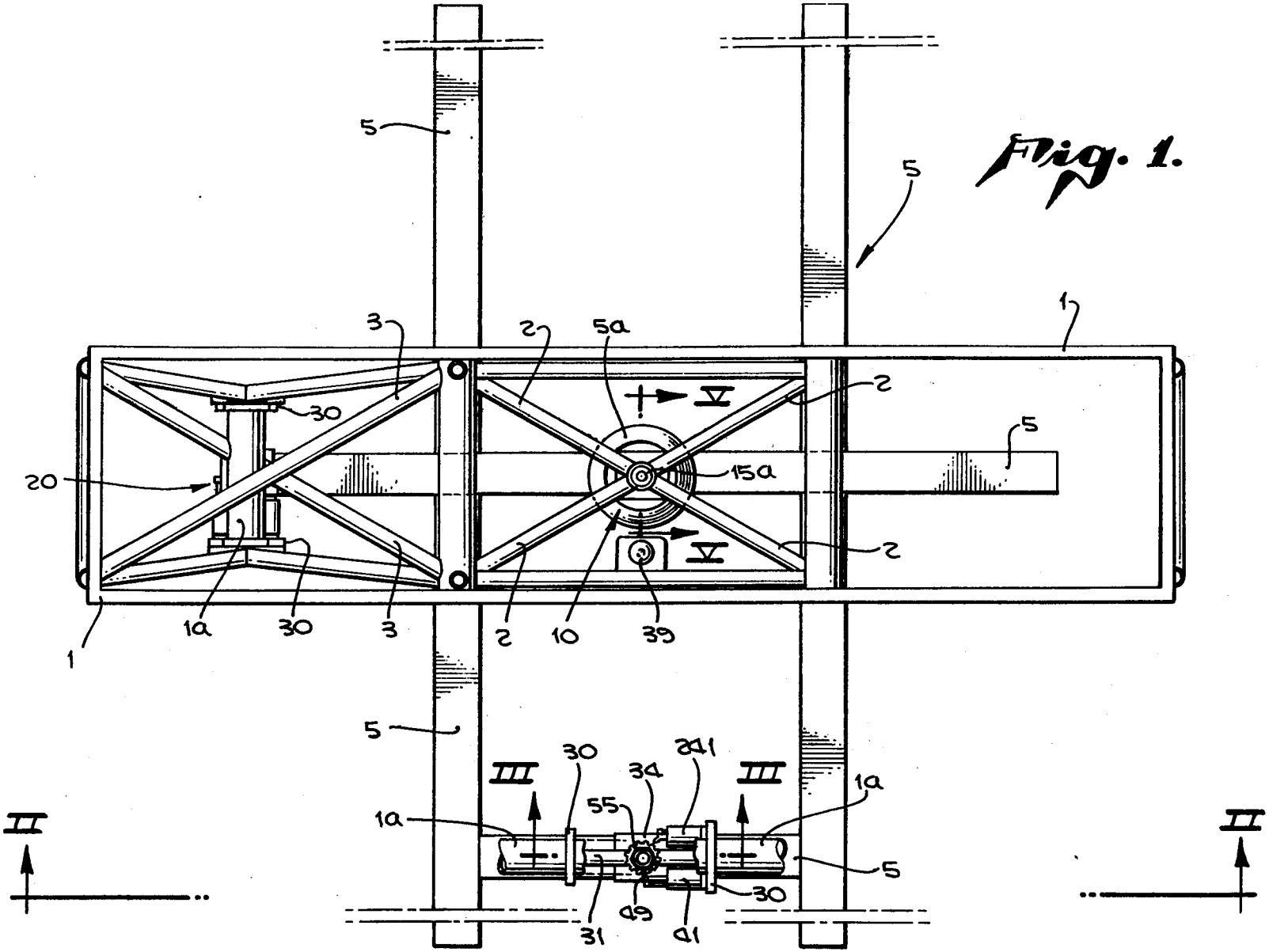
FIG. 1 is a top plan view of a sub-sea drilling template and an underlying support frame which rests on the sea bottom.
Figure 2:
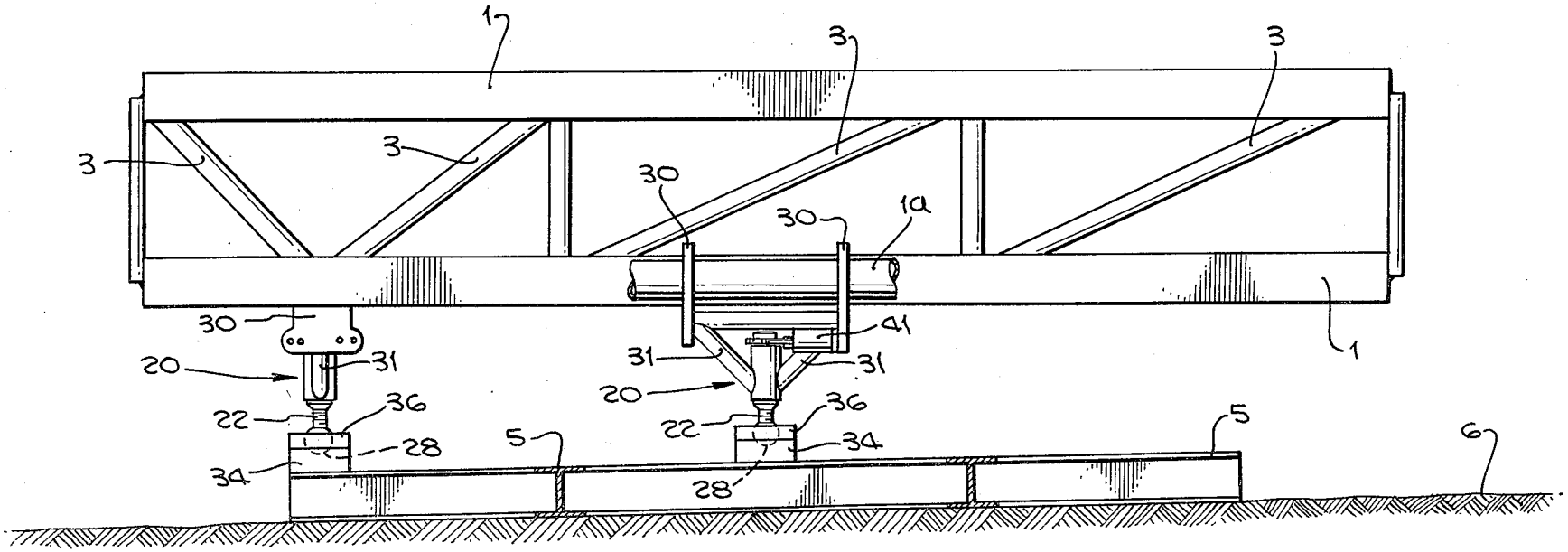
FIG. 2 is a side view through the plane II—II of FIG. 1 showing the leveling means of the present invention operationally interconnecting the support frame and the drilling template.

DETAILED DESCRIPTION OF AN EXEMPLARY EMBODIMENT:

Referring first to FIGS. 1 and 2, a sub-sea leveling and support apparatus for support and leveling a sub-sea drilling template for sub-sea well drilling operations is shown. A support frame shown generally at 5 lies on the sea bottom and provides a stable reference surface for a sub-sea drilling template 1 relative to the underlying sea bottom surface shown generally at 6. Sub-sea drilling template 1 is provided with a peripheral portion 1a to which portions of the leveling means of the present invention are mounted. Additionally, support trusses 2 operationall interconnect the sub-sea drilling template with universal pivot means indicated generally at 10 in FIG. 5 which pivotally support the sub-sea drilling template. Cross braces 3 add rigidity and strength to the sub-sea drilling template and are shown in FIGS. 1, 2, 6, 7, and 9.

Figure 5:
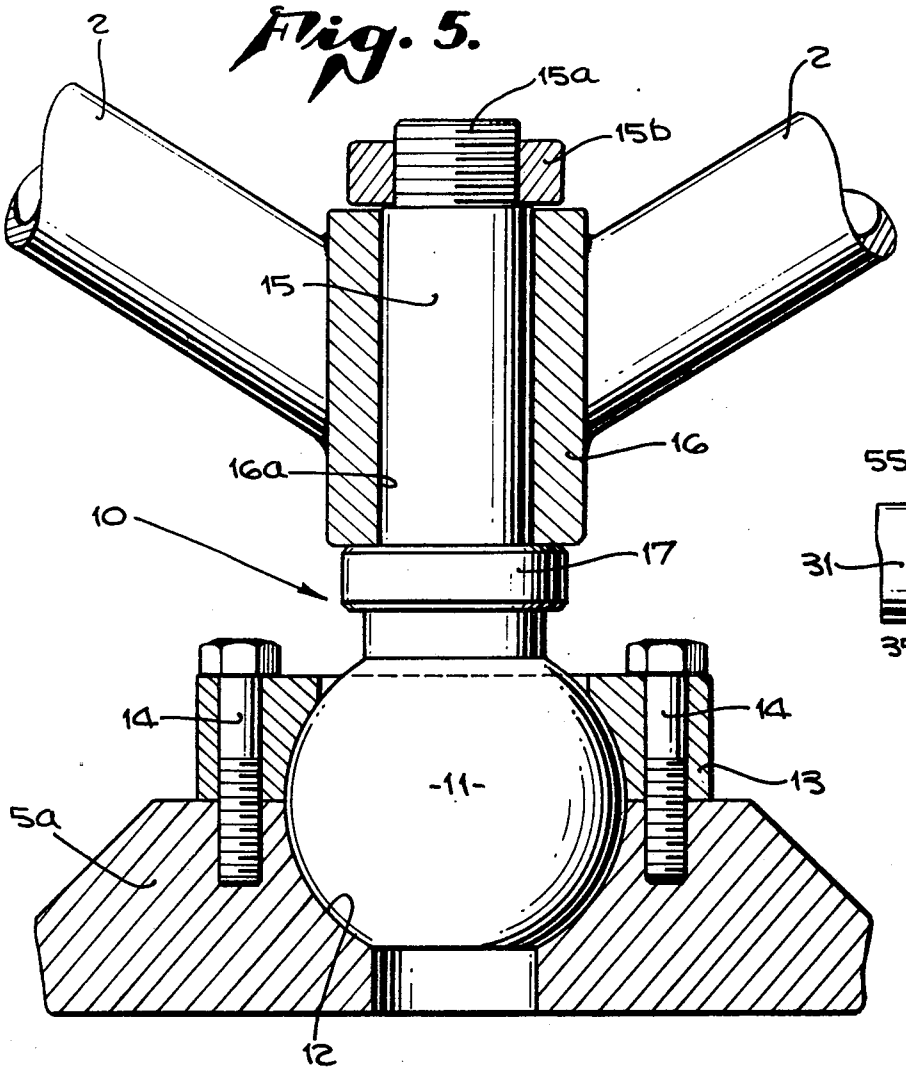
FIG. 5 is a partial sectional view through the plane V—V of FIG. 1 showing the pivot means of the present invention.
Figure 6:
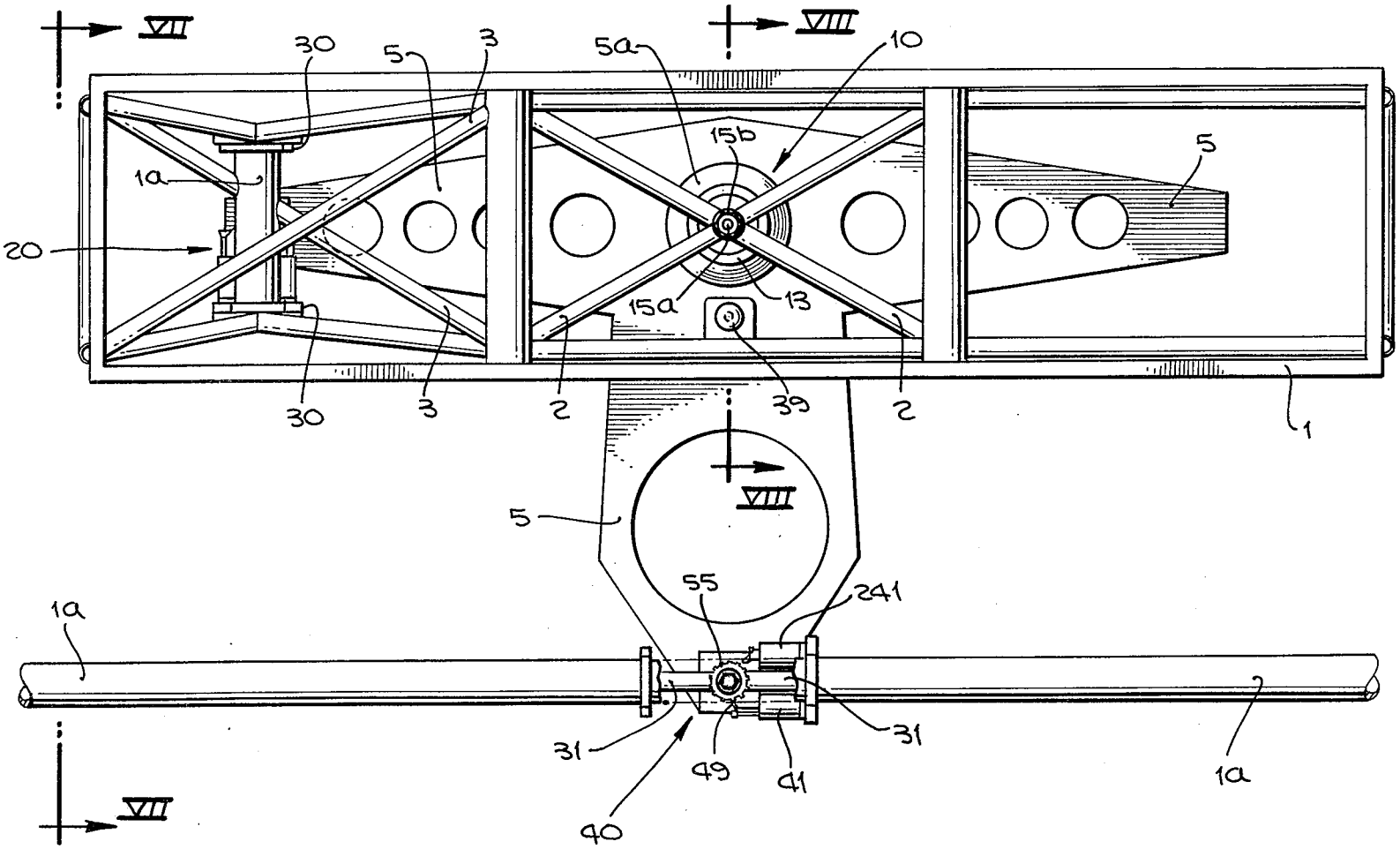
FIG. 6 is a top plan view of an exemplary embodiment of the present invention wherein the support frame has been adapted for use on relatively soft sea bottoms.

Universal pivot means shown generally at 10 in FIGS. 1 and 5 operationally interconnect support frame 5 and sub-sea drilling template 1. Sub-sea drilling template 1 is thus pivotally supported with respect to the underlying sea bottom surface which has been indicated at 6. Universal pivot means 10 comprises ball support means having cooperating ball element 11 and socket element 12 which allow the sub-sea drilling template which is being oriented to pivot, relative to support frame 5, about a plurality of axes extending through the center of ball element 11.

As best seen in FIG. 5, ball element 11 is provided with a mounting shaft 15 which is received by aperture 16*a* through mounting block 16 which is, in turn, securely joined to support trusses 2. Mounting shaft 15 is provided with threaded portions 15*a* which extend beyond mounting block 16 when mounting shaft 15 is inserted through aperture 16*a* such that an associated locking nut 15*b* can be threaded thereon to secure mounting shaft 15 within mounting block 16 thereby securely mounting ball element 11 to support truss 2 of sub-sea drilling template 1. In order to provide a spaced relationship between mounting block 16 and ball element 11, an abuttment 17 is provided in association with mounting shaft 15. Additionally, abuttment 17 may be spaced along mounting shaft 15 from the threaded portion 15*a* thereof a distance slightly greater than the longitudinal extent of mounting block 16, thereby allowing lock nut 15*b* to be secured with respect to threaded portion 15*a* while, at the same time, not binding against mounting block 16. This will allow rotation of mounting shaft about its longitudinal central axis is such rotation is required during the pivoting action of ball element 11.

Ball element 11 is received by socket element 12 of mounting support block 5*a* which is secured to support frame 5. To retain ball element 11 within socket element 12, retainer 13 having an interior socket portion of a curvature which corresponds to the curvature of ball element 11 is secured to mounting block 5*a* by bolts 14 as best seen in FIG. 5.

From a consideration of FIGS. 1 and 5 it may be readily observed that by locating the universal pivot means at a generally central portion of the sub-sea drilling template, the plane of the sub-sea drilling template may be varied infinitely as to direction and degree subject only to the restrictions upon the rotation of ball element 11 about its center which are placed there by the design of the associated mounting support block 5*a*, retainer 13 and mounting shaft 15.

The desired application of the instant invention is to assure a horizontal or level sub-sea drilling template regardless of the slope or contour of the underlying sea bottom surface. The universal pivot capability of the ball element 11/socket element 12 ball support means of the present invention allows an associated leveling means which operationally interconnects the support frame 5 with the sub-sea drilling template 1 to vary the angular orientation of the sub-sea drilling template about the universal pivot means relative to support frame 5 to achieve the desired substantially horizontal and level orientation of the sub-sea drilling template in a highly simplified and convenient manner.

Figure 3:
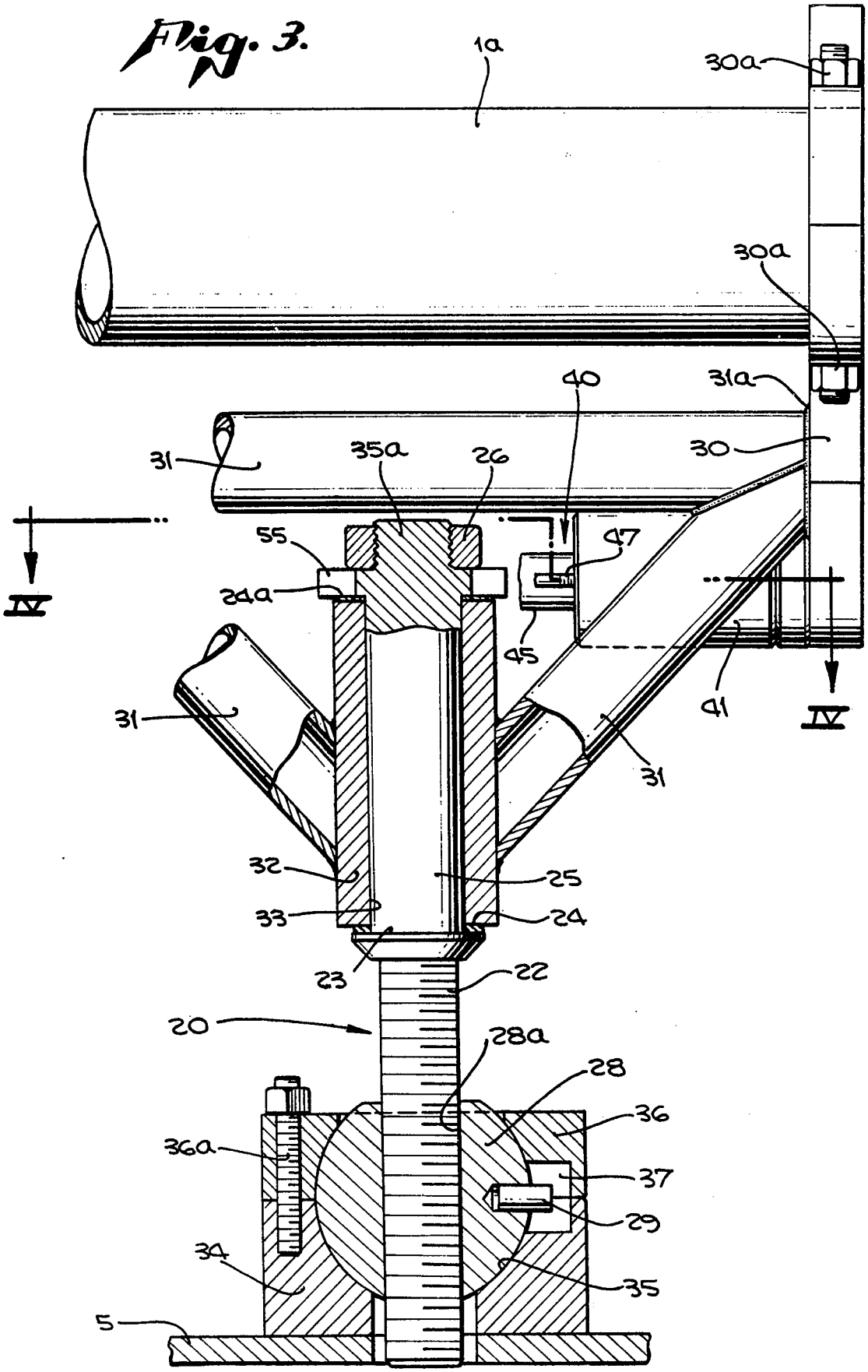
FIG. 3 is a partial sectional view through the plane III—III of FIG. 1 showing in detail the leveling means of the present invention.

The exemplary embodiment in leveling means of the present invention comprises at least two leveling jacks 20 as best seen in FIG. 2 and as is shown in detail in FIG. 3. Mounting means are provided for mounting the leveling jacks such that the leveling jacks operationally interconnect support frame means 5 and sub-sea drilling template 1 and are off-set from each other and from universal pivot means 10 with respect to their connection to sub-sea drilling template 1 and are positioned such that each leveling jack is off-set from a line through the universal pivot means 10 and each other one of the jacks connected to the sub-sea drilling template. In the exemplary embodiments shown in FIGS. 1, 2, 6 and 7, the leveling jacks are off-set from each other with respect to universal pivot means 10 by an amount substantially equivalent to 90°. In thus mounting leveling jacks 20 with respect to each other and with respect to universal pivot means 10, maximum stability of sub-sea drilling template 1 with respect to support frame means 5 is obtained.

Referring to FIG. 3, a preferred exemplary embodiment in mounting means for mounting the leveling jacks is shown. A leveling jack, shown generally at 20, is operationally interconnected between peripheral portion 1*a* of sub-sea drilling template 1 and support frame means 5 by mounting bracket 30 which is secured to peripheral portion 1*a* by means of mounting bolts 30*a* and mounting block 34 which is secured to support frame means 5 by various means such weldment or the like.

Jack strut assembly 31 secured to mounting bracket 30 by means of weldment 31*a* comprises a central body portion 32 having a central bore 33 therethrough for receiving mounting shaft 25 of leveling jack 20. Mounting shaft 25 is journalled in central bore 33 thereby allowing mounting shaft 25 to rotate relative to central body portion 32 of jack strut assembly 31. Mounting shaft 25 of leveling jack 20 is retained within central bore 33 by means of abuttment shoulder 23 and gear means 55 which is non-rotatably mounted to mounting shaft 25 in spaced relationship from abuttment 23 and which is secured by locking nut 26. As may be seen from FIG. 3, central body portion 25 of jack strut assembly 31 rest upon, and is supported by, abuttment 23. In order to provide a non-galling, low friction contact therebetween, bearing element 24 is provided. An additional bearing element 24a is also provided between gear means 55 and the upper end of central body portion 32. In thus securing leveling jack 22 to peripheral portion 1a of the sub-sea drilling template, axial movement of mounting shaft 25 within central bore 23 is limited by abuttment means 23 and gear means 55 without interfering with the rotation of the leveling jack.

The lower portion of the leveling jack is secured to support frame means 5 by means of a threaded interconnection between jack screw 22 and threaded aperture 28a of ball 28. Ball 28, in turn, is mounted within socket 35 of mounting block 34 which has been secured to support frame means 5 by welding or the like and is retained therein by retaining ring 36 which is secured to mounting block 34 by fastening means exemplified by bolt 36a in FIG. 3. By thus providing a ball and socket interconnection between leveling jack 20 and support frame means 5, variable axial alignment of the leveling jack with respect to the plane of the support frame means is provided by the rotation of ball 28 within socket 35.

Adjusting means are provided for adjusting leveling jack 20 to selectively raise and lower portions of sub-sea drilling template 1 with respect to support frame means 5. Included in the adjusting means are sensing means for sensing angular deviation between the sub-sea drilling template 1 and a desired horizontal reference plane. In the exemplary embodiment shown in FIGS. 1 and 6, a bull's eye level 39 mounted in the center of sub-sea drilling template 5 detects any angular deviation of the template from a desired horizontal plane. The bull's eye level 39 is observed via a remote television link (not shown) to determine the need for any corrective adjustment of the template. Other electronic sensing devices may be utilized however, and still fall within the intended scope of the present invention.

Hydraulic means are provided for operating leveling jacks 20 independently of each other. In the exemplary embodiment of the present invention shown in FIGS. 1 and 6 and, as shown in detail in FIGS. 3 and 4, adjusting means indicated generally at 40 comprise hydraulic means for operating the leveling jacks 20 independently of each other. Additionally, the hydraulic means are capable of bi-directional operation for selectively and independently rotating each one of the leveling jacks in either direction about a central axis of the jack. The hydraulic means of the exemplary embodiment of the present invention comprise paired hydraulic units 41 and 241 which operate in a similar fashion to rotate the leveling jack in different directions with respect ot each other. For the sake of brevity, only the operation of hydraulic unit 41 will be discussed herein, it being understood that the description pertains to unit 241 as well.

Figure 4:
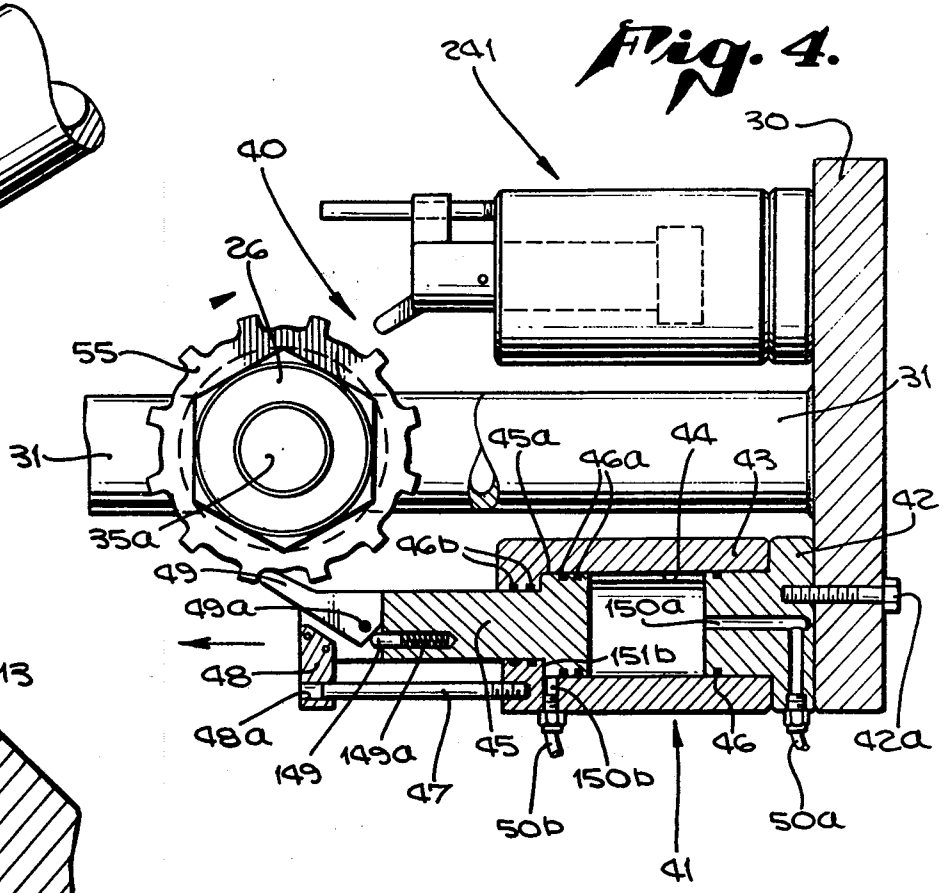
FIG. 4 is a partial sectional view through the plane IV—IV of FIG. 3 showing in detail the mechanism which operates the leveling means.

To operatively rotate leveling jacks 20, adjusting means 40 interacts with gear means 55 which is non-rotatably secured to mounting shaft 25 and retained in position thereon by means of a threaded interconnection between locking nut 26 and threaded portion 35a of mounting shaft 25. Hydraulic unit 41 operates pawl means 49 between positions of engagement and disengagement with gear means 55 in order to selectively rotate gear means 55. As best seen in FIG. 4, hydraulic unit 41 comprises the base mount 42 which is secured to mounting bracket 30 by means of mounting bolt 42a. Body portion 43 having internal cylinder walls 44 is secured to base mount 42 and seal element 46 prevents hydraulic leakage therebetween. Piston 45 having an interior radius 45a is fitted within hydraulic cylinder 44 and sealing elements 46a prevent hydraulic leakage between the cylinder and the piston. Additional sealing elements 46b provide a fluid tight seal between portions of the piston which extend beyond body portion 43 of the hydraulic unit to prevent the leakage of hydraulic fluid from hydraulic unit 41 and also prevent the entry of sea water into the hydraulic system. Piston 45 is bi-directionally operated within cylinder 44 by alternately supplying pressurized hydraulic fluid through hydraulic lines 50a and 50b. Hydraulic fluid from line 50a enters passage 150a within base mount 42 and is directed to chamber 151a thereby forcing piston 45 to the position shown in FIG. 4. To reverse the direction of operation of piston 45, hydraulic fluid is directed from hydraulic line 50b to passage 150b through body portion 43 of the hydraulic unit and enters hydraulic chamber 151b which is formed between cylinder 44 and an anterior radius 45a on piston 45. Hydraulic fluid is allowed to bleed from chamber 151a via passage 150a back through hydraulic line 50a, and piston 45 is urged to a position which represented by the dotted line depiction in hydraulic unit 241 in FIG. 4.

Pawl means 49 is connected to piston 45 by means of retaining pin pivot 49a. A spring loaded bias pin 149 operates within aperture 149a within piston 45 to bias pawl means 49 into engagement with gear 55. By allowing pawl means 49 to pivot about retaining pin 149, pawl 49 is provided with the capability to function as a ratchet and slide over a following gear tooth on gear means 55 as piston 45 is withdrawn to the dotted line position shown in hydraulic unit 241 of FIG. 4. The cycling of piston 45 from right to left in FIG. 4 causes gear means 55 to rotate in a clockwise direction which will result in a clockwise rotation of jack screw 22 as shown in FIG. 3. This will draw the template and support frame together at that point, in effect, lowering the template relative to the sea bottom at that point as may be visualized from a consideration of FIG. 3. To insure that linear movement of piston 45 is translated to rotational movement of gear means 55, and to prevent pawl means 49 from slipping out of contact with gear means 55, a guide rod 47 is attached to body portion 43 of hydraulic unit 41 and extends through an aperture 48a in guide tab 48 which is attached to piston 45. Also, this prevents piston 45 from binding in cylinder 44 as it approaches the fully extended position shown in FIG. 4.

As may be seen from the foregoing description of the operation of pawl means 49, pawl means 49 is hydraulically operated between positions engagement and disengagement with gear means 55 for selectively rotating gear means 55 and, in turn, rotating mounting shaft to 25.

Figures 9, 10, 11:
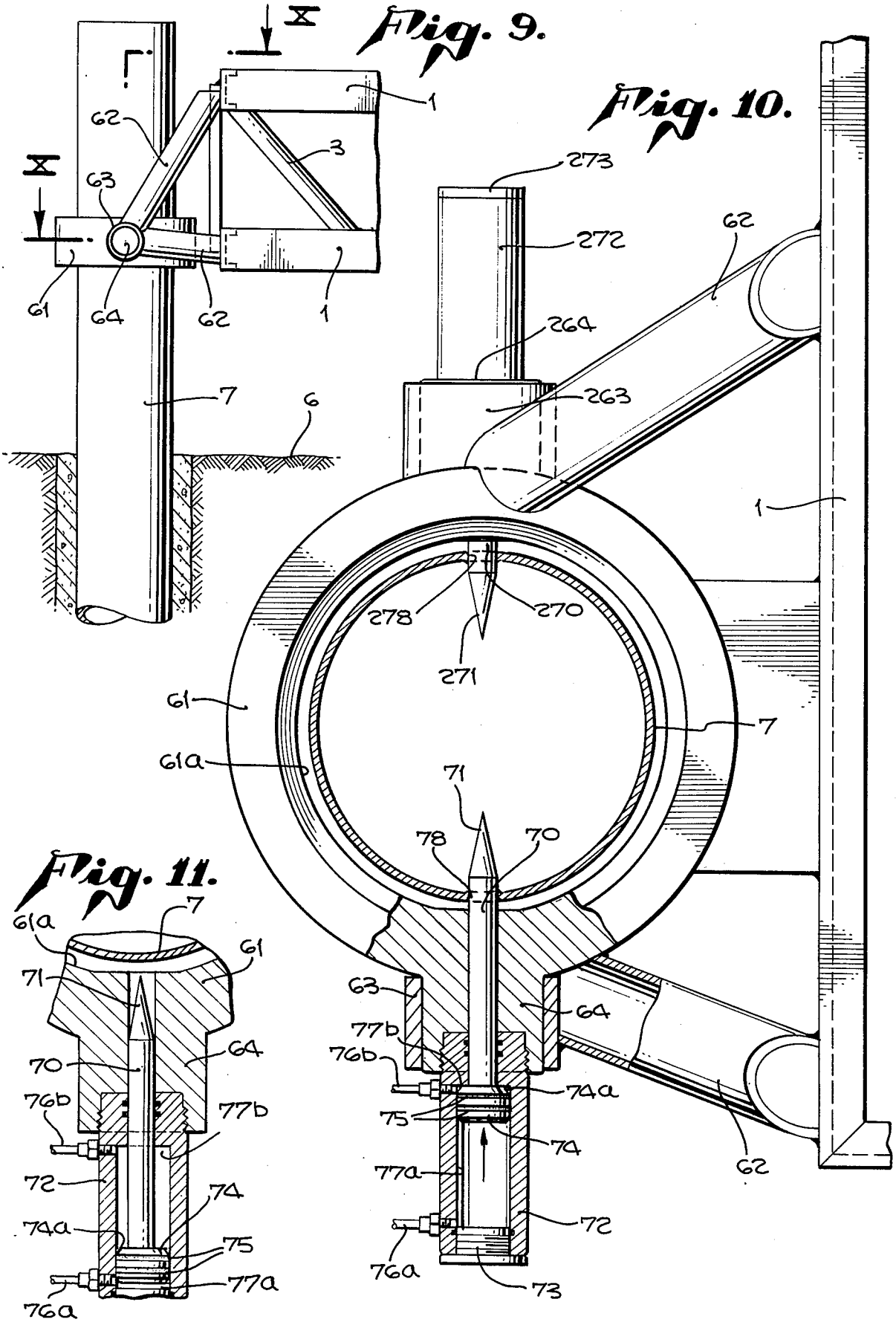
FIG. 9 is a partial side view showing the drilling template of the present invention and means for securing the drilling template to an anchor pile which has been cemented into the sea bottom.
FIG. 10 is a partial sectional view through the plane X—X of FIG. 9 showing the locking pins of the present invention piercing an associated anchor pile to securely position the drilling template relative to the anchor pile.
FIG. 11 is sectional view showing in detail the locking pin of the present invention in position prior to piercing the associated anchor pile.

Once a desired angular orientation between the sub-sea drilling template 1 and support frame means 5 has been achieved by selectively raising and/or lowering the two leveling jacks relative to each other and universal pivot means 10, retaining means fixedly secure sub-sea drilling template 1 with respect to support frame means 5. Alignment means associated with sub-sea drilling template 1 locate anchor points for the template. The alignment means of the present exemplary embodiment comprise a plurality of brackets pivotally mounted to the sub-sea drilling template. As best seen in FIGS. 9 and 10, ring-like alignment brackets 61, each having a central bore 61*a* and being provided with pivot shaft portions 64 and 264, are pivotally mounted to sub-sea drilling template 1 by means of mounting arms 62 having pivot sleeves 63 and 263 which receive pivot shafts 64 and 264.

In the exemplary embodiment of the present invention discussed herein, anchor means for anchoring sub-sea drilling template 1 to an underlying sea bottom 6 comprise a plurality of anchor pilings 7 secured beneath and extending above the underlying sea bottom 6 and alignment means which comprise a plurality of ring-like alignment brackets 61 each having a central bore 61*a* for slidably receiving one of the anchor pilings 7. Alignment brackets 61 are pivotally mounted to sub-sea drilling template 1 and are oriented about axes through pivot shaft 64 and 264 which are perpendicular to central bore 61*a* of alignment bracket 61.

After leaving the sub-sea drilling template 1, anchor pile holes are drilled into the sea bottom 6 using central bore 61*a* of alignment brackets 61 as a guide. Anchor piles 7 are then run into the holes in the sea bottom and are cemented in place. By thus securing anchor piles 7 in the sea bottom, the anchor piles which are positioned at the anchor points located by alignment brackets 61 anchor sub-sea drilling template 1 to the underlying sea bottom 6 upon the operation of releasable locking means which secure the alignment brackets 61 with respect to anchor piles 7.

Once anchor piles 7 have been run and cemented into position, sub-sea drilling template 1 is re-levelled if necessary and, when the template is in the proper position, it is locked to each anchor pile 7 by releasable locking means as best shown in FIGS. 10 and 11.

The releasable locking means of the exemplary embodiment shown in FIGS. 10 and 11 comprise locking pin means 70 and 270 mounted to alignment bracket 61 for engaging cooperation locking aperture means 78 and 278 in anchor pile 7.

Means are provided for selectively operating locking pins 70 and 270 between positions of engagement and disengagement with locking aperture means 78 and 278. Again referring to FIGS. 10 and 11, the exemplary embodiment shown therein utilizes hydraulic means for selectively operating the locking pins. Locking pins 70 and 270 are each provided with a sharpened tip at 71 and 271 which is positioned adjacent anchor pile 7. Once sub-sea drilling template 1 is positioned in a desired orientation, locking pins 70 and 270 which are mounted to alignment bracket 61 are driven from the position shown in FIG. 11 to the positions shown in FIG. 10 thereby piercing anchor pile 7 to provide the cooperating locking aperture means 78 and 278.

The means for operating locking pins 70 and 270 from the position shown in FIG. 11 to the position shown in FIG. 10 are similar and, for the sake of brevity, only the operation of locking pin 70 will be discussed herein, it being understood that the description pertains to locking pin 270 as well.

Hydraulic fluid is introduced through hydraulic line 76*a* into hydraulic chamber 77*a* of hydraulic cylinder 72. Hydraulic line 76*b* is opened and is allowed to operated as a bleed valve for hydraulic chamber 77*b*. As the hydraulic pressure increases within hydraulic chamber 77*a* hydraulic piston 74 having seals 75 is driven from the position shown in FIG. 11 to the position shown in FIG. 10. To reverse the operation of locking pin 70, hydraulic line 76*a* is opened and allowed to function as a bleed valve, hydraulic fluid under pressure is introduced through hydraulic line 76*b* into hydraulic chamber 77*b* which is formed between an interior end of hydraulic cylinder 72 and anterior radius 74*a* of piston 74 and pin 70 is urged from the position shown in FIG. 10 to the position shown in FIG. 11.

Although the exemplary embodiment of releasable locking means shown in FIGS. 10 and 11 has been discussed in detail herein other exemplary embodiments contemplate the use of a plurality of individual locking pins mounted to each one of a plurality of alignment brackets each locking pin being disposed to engage a cooperating one of a plurality of locking apertures in an associated anchor pile. Further, although the exemplary embodiment discussed herein utilizes locking pins which are associated with alignment brackets and which pierce an anchor pile, it should be understood that the same result could be achieved by associating the locking pins with the anchor pile and piercing through the alignment brackets.

Figure 7:
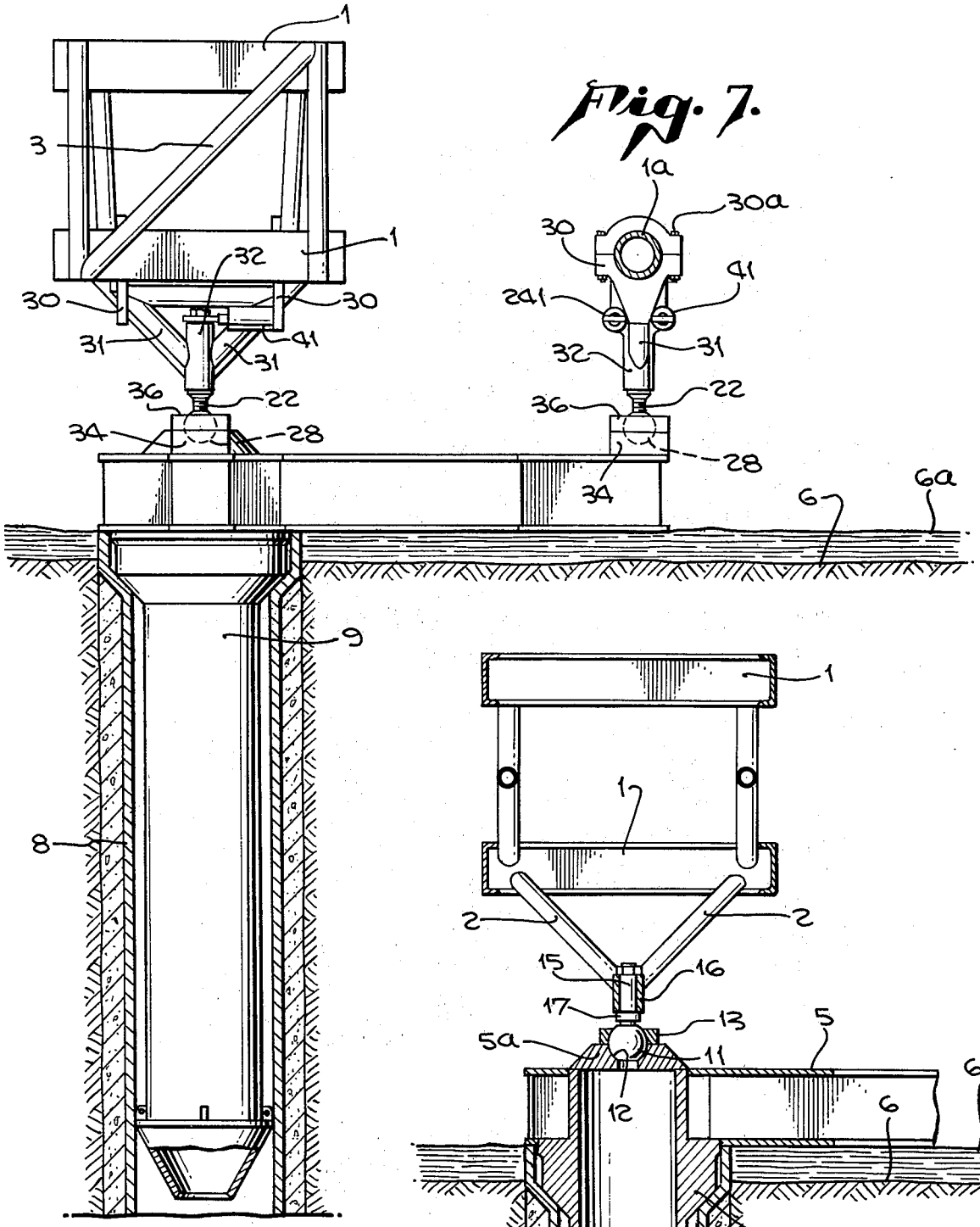
FIG. 7 is a partial sectional view through the plane VII—VII of FIG. 6 showing the spaced and orientational relationships between cooperating leveling means as well as showing in detail the specific adaptive modification of the support frame utilized when soft sea bottom conditions are encountered.
Figure 8:
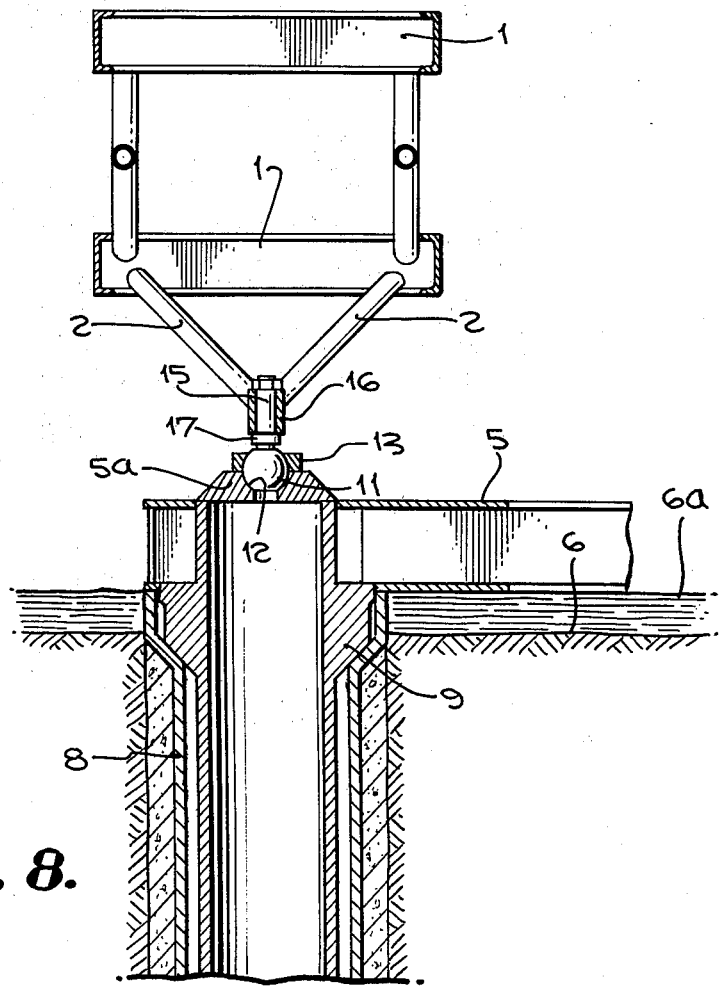
FIG. 8 is a partial sectional view through the plane VIII—VIII of FIG. 6 showing the relationship between the modified support frame and the pivotal means of the present invention.

The foregoing exemplary embodiment has considered a support frame means 5 which rest on a firm sea bottom 6. However, for applications wherein the sea bottom is covered with a soft layer of mud as shown at 6*a* in FIGS. 7 and 8 and hence will not firmly support support frame means 5, mandrel means 9 are provided which project from a lower surface of support frame means 5, as best seen in FIGS. 7 and 8. Mandrel means 9 engages a sub-surface pile joint 8 which has been run and cemented into sea bottom 6 this provides temporary support for support frame means 5 when a soft underlying surface is encountered and enables the sub-sea drilling template 1 to be levelled. Once the sub-sea drilling template 1 has been levelled it is anchored as has been discussed prior.

From a consideration of the foregoing descriptions of various exemplary embodiments of the present invention, it may be seen that the present invention also teaches a method of leveling and supporting a sub-sea drilling template for sub-sea well drilling operations which comprises the steps of providing a stable reference surface for the template relative to an underlying sea bottom surface, operationally interconnecting the reference surface and the template, pivotally supporting the template with respect to the reference surface and pivotally varying the angular orientation of the template relative to the reference surface. Additionally, the method of the present invention comprises the additional step of fixedly securing the template with respect to the reference surface once a desired angular orientation therebetween has been achieved.

The step of pivotally supporting the template includes the sub-step of providing ball support means having cooperating ball and socket elements which operationally connect the template and reference surface and the additional sub-step of allowing the template to pivot relative to the reference surface about a plurality of axes extending through the center of the ball element.

The step of pivotally varying the angular orientation of the template relative to the reference surface comprises the sub-steps of mounting at least two leveling jacks spaced apart from each other and from the ball support means within a common plane, positioning the jacks such that each jack is off-set from a line through the ball support means and each other one of the jacks along the common plane and adjusting the jacks to raise or lower portions of the template with respect to the support frame means, thereby pivoting the template about the ball support means with respect to the support frame means. As has been discussed, the method of the present invention includes the additional step of pivotally varying the angular orientation of the template relative to the reference surface from a remote location such as a surface drilling platform or drilling ship.

Once a desired angular orientation between the template and the reference surface has be achieved, the step of fixedly securing the template with respect to the reference surface comprises the additional sub-steps of providing alignment means associated with the template for locating anchor point for the template, positioning anchor means at the anchor points for anchoring the template to an underlying sea bottom and releasably locking the alignment means with respect to the anchor means.

Having thus described several exemplary embodiments of an improved sub-sea leveling and support apparatus for leveling and supporting a sub-sea drilling template for sub-sea well drilling operations and a method for leveling and supporting a sub-sea drilling template for sub-sea well drilling operations, it should be understood by those skilled in the art that the various alternatives and modifications thereof may be made within the scope and spirit of the present invention which is defined by the following claims.

I claim:

1. A remotely operable sub-sea drilling template and leveling support apparatus for sub-sea well drilling operations, comprising:

a sub-sea well drilling template;

support frame means for providing a stable reference surface for said template when positioned beneath the sea surface relative to an underlying sea bottom;

pivot means for interconnecting said support frame means and said template for pivotally supporting said template with respect to said sea bottom;

leveling means interconnected between said support frame means and said template for varying the angular orientation of said template beneath said sea surface about said pivot means relative to said support frame means; and control means at a location remote from said levelling means and connected thereto for operating said leveling means to level said template beneath said sea surface.

2. The apparatus of claim 1 comprising:

retaining means for fixedly securing said template with respect to said support frame means once a desired angular orientation therebetween has been achieved.

3. The apparatus of claim 1 wherein said pivot means comprises ball support means having cooperating ball and socket elements for allowing said template being oriented to pivot relative to said support frame means about a plurality of axes extending through the center of said ball element.

4. The apparatus of claim 1 wherein said leveling means comprises:

at least two leveling jacks;

mounting means for mounting said jacks spaced apart from each other and from said pivot means within a common plane and positioned such that each jack is off-set from a line through said pivot means and each other one of said jacks along said common plane; and adjusting means for adjusting said jacks.

5. The apparatus of claim 4 wherein said mounting means positions said leveling jacks off-set from each other in said plane with respect to said pivot means by an amount substantially equivalent to 90°.

6. A sub-sea leveling and support apparatus for leveling and supporting a sub-sea drilling template for sub-sea well drilling operations, comprising:

support frame means for providing a stable reference surface for said template relative to an underlying sea bottom surface;

universal pivot means operationally interconnecting said support frame means and said template for pivotally supporting said template with respect to said sea bottom surface; and leveling means operationally interconnecting said support frame means and said template for varying the angular orientation of said template about said pivot means relative to said support frame means;

wherein said leveling means comprises:

at least two leveling jacks;

mounting means for mounting said jacks spaced apart from each other and from said pivot means within a common plane and positioned such that each jack is off-set from a line through said pivot means and each other one of said jacks along said common plane; and adjusting means for adjusting said jacks wherein said adjusting means comprises:

sensing means for sensing angular deviation between said template and a horizontal reference plane;

hydraulic means for operating said leveling jacks independently of each other; and control means at a location remote from said jacks for regulating said hydraulic means to selectively operate said leveling jacks to bring said template to a desired angular orientation relative to said horizontal reference plane.

7. The apparatus of claim 4 wherein said adjusting means comprises:

bi-directional operating means for selectively and independently rotating each one of said leveling jacks in either direction about a central axis thereof;

gear means non-rotatably mounted to said leveling jacks for engaging said bi-directional operating means and wherein said bi-directional operating means comprises:

pawl means hydraulically operated between positions of engagement and disengagement with said gear means for selectively rotating said gear means.

8. A method of leveling a sub-sea drilling template for sub-sea well drilling operations comprising the steps of:

providing a stable reference surface for said template relative to an underlying sea bottom surface;

pivotally supporting said template beneath the sea with respect to said reference surface;

providing means operable from a remote location for varying its angular orientation of said template; and varying the angular orientation of said template beneath the sea relative to said reference surface from a remote location above the sea.

9. The method of claim 8 wherein said step of pivotally supporting said template comprises the sub-steps of:

providing ball support means having cooperating ball and socket elements operationally connecting said template and said reference surface; and allowing said template to pivot relative to said reference surface about a plurality of axes extending through the center of said ball element.

10. The method of claim 9 wherein said step of pivotally varying the angular orientation of said template relative to said reference surface comprises the substeps of:

mounting at least two leveling jacks spaced apart from each other and from said ball support means within a common place;

positioning said jacks such that each jack is off-set from a line through said ball support means and each other one of said jacks along said common plane; and adjusting said jacks to raise or lower portions of said template with respect to said support frame means, thereby pivoting said template about said ball support means with respect to said support frame means.

11. An adjustable sub-sea well drilling template having apparatus for leveling beneath the sea comprising:

drilling template means for receiving and mounting a well head christmas tree assembly;

support frame means for providing a stable reference surface for said template means relative to an underlying sea bottom surface;

universal pivot means interconnecting said template means and said support frame means for pivotally supporting said template means beneath the sea with respect to said support frame means;

leveling means interconnecting said template means and said support frame means for varying the angular orientation of said template about said universal pivot means relative to said support frame means; and control means operable from above the sea for operating said leveling means to level said drilling template means when located remotely beneath the sea.

* * * * *